US005601149A

United States Patent [19]

Kawasaki et al.

[11] Patent Number: 5,601,149

[45] Date of Patent: Feb. 11, 1997

[54] NOISE REDUCTION MECHANISM FOR PERCUSSION TOOLS

[75] Inventors: Yoshimitsu Kawasaki, Mito; Mitsuyuki Ishikawa, Katsuta; Takao Tanabe, Mito; Toshiaki Uchida, Katsuta, all of Japan

[73] Assignee: Hitachi Koki Company Limited, Tokyo, Japan

[21] Appl. No.: 378,374

[22] Filed: Jan. 25, 1995

[30] Foreign Application Priority Data

Feb. 25, 1994 [JP] Japan ..... 6-028081

[51] Int. Cl.[6] ..... B25D 17/11; B25B 21/02

[52] U.S. Cl. ..... 173/93.5; 173/109; 173/211

[58] Field of Search ..... 173/90, 93, 93.5, 173/94, 176, 178, 104, 109, 216, 217, 210, 211, 212

[56] References Cited

U.S. PATENT DOCUMENTS

| | | | |
|---|---|---|---|
| 1,451,102 | 4/1923 | Neale | 173/171 |
| 3,174,606 | 3/1965 | Hornschuch et al. | 192/150 |
| 3,369,615 | 2/1968 | Maffey, Jr. et al. | 173/93.6 |
| 3,847,229 | 11/1974 | Wanner et al. | 173/118 X |
| 4,913,242 | 4/1990 | Lo | 192/56 R X |

FOREIGN PATENT DOCUMENTS

| | | |
|---|---|---|
| 761453 | 3/1953 | Germany . |
| 1070558 | 12/1959 | Germany . |
| 55-44136 | 3/1980 | Japan . |
| 56-6293 | 2/1981 | Japan . |

*Primary Examiner*—Scott A. Smith
*Assistant Examiner*—Jay A. Stelacone
*Attorney, Agent, or Firm*—Pollock, Vande Sande & Priddy

[57] ABSTRACT

A percussion hammer tool comprises a spindle 1 causing rotation about an axis thereof. The spindle 1 is driven by a motor M. A hammer 3, slidably coupled with the spindle 1, generates a percussion force to rotate and hit an anvil. The anvil is divided into an engaging portion 7 engageable with the hammer 3 and a tip tool holding portion 8 holding a tip tool 16. The engaging portion 7 and the tip tool holding portion 8 are locked with each other. A torque transmitting mechanism 11 makes the engaging portion 7 and the tip tool holding portion 8 displaceable with each other telescopically in an axial direction. A cushion member 10 is provided in a clearance 9a between the engaging portion 7 and the tip tool holding portion 8, thereby transmitting an angular component of the percussion force while absorbing an axial component of the percussion force. An additional cushion member 13 may be interposed between the spindle 1 and the anvil.

11 Claims, 7 Drawing Sheets

NOISE REDUCTION MECHANISM FOR PERCUSSION TOOLS

BACKGROUND OF THE INVENTION

1. Field of the Invention

The present invention relates to percussion tools.

2. Prior Art

FIG. 9 shows an arrangement of a conventional percussion tool. The disclosed percussion tool comprises a spindle 1 extending in an axial direction, and a cylindrical hammer 3 coaxial with the spindle 1. A spindle cam 2, shaped into a groove, is formed on an outer surface of the spindle 1, while a hammer cam 4, shaped into a recess, is formed on an inside surface of the hammer 3. A steel ball 5, interposed between the spindle 1 and the hammer 3, engages with both the spindle cam 2 and the hammer cam 4. With this engaging mechanism, the hammer 3 can advance forward or retract backward with respect to the spindle 1 in the axial direction. A spring 6 is disposed behind the hammer 3 to generate a force pushing the hammer 3 in the axial direction toward the anvil 12. The anvil 12 is provided adjacent to and in front of the spindle 1 on an extension line of the axis of the spindle 1. A flange of the anvil 12, formed at the rear end thereof, is engageable with a bifurcated front end of the hammer 3. When an excessive load is applied to the anvil 12, the flange of the anvil 12 pushes the hammer 3 rearward in the axial direction against the elastic force of the spring 6. At the moment the engagement is released between the anvil 12 and the hammer 3, the hammer 3 causes a free (no-load) angular displacement with respect to the anvil 12 accelerating its angular speed until it hits the flange of the anvil 12 again, thereby realizing a well-known percussion operation.

As illustrated in FIG. 10, after an engaging edge of the hammer 3 is disengaged from one flange of the anvil 12 (shown in the left of the drawing), the hammer 3 causes a free rotation in an angular direction with respect to the anvil 12 until it hits another flange of the anvil 12 (shown in the right of the drawing). In this case, the hammer 3 advances forward along the lead of the spindle cam 2 and the hammer cam 4. Thus, the hammer 3 hits the anvil 12 with an oblique force F, which is divided into an angular component F1 acting as percussion force and an axial component F2 acting in the axial direction and normal to the angular component F1.

Furthermore, when the hammer 3 reaches a bottom dead center of the spindle cam 2 before it hits the anvil 12 as illustrated in FIG. 11, an axial component F2' is transmitted via the steel ball 5 to the spindle 1. Then, the force is transmitted from the spindle 1 to the anvil 12 via an abutting surface 15 where the spindle 1 and the anvil 12 are brought into contact with each other.

The angular component F1 or F1' is necessary to generate a force for rotating or fastening a screw 17 via a tip tool 16 into an opponent member 18. Meanwhile, the axial component F2 or F2' which does not contribute to the screw fastening operation is transmitted to the opponent member 18 by way of the anvil 12, the tip tool 16 and the screw 17, causing vibration of the opponent member 18. Thus, the axial component F2 or F2' becomes the main cause of percussion noises generated from the opponent member 18. The level of such percussion noises generated from the opponent member 18 possibly increases up to 75% of the total noise energy generated in the screw fastening operation. It is needless to say that such noises will deteriorate work efficiency and, therefore, should be decreased from the view point of prevention of public nuisance.

A technology for reducing noises in the percussion tools is, for example, disclosed in the Japanese Utility Model No. SHO 56-6293/1981. According to this technology, a plurality of resilient members, such as synthetic rubber, are interposed between percussion operating members and a casing in order to prevent vibration of the percussion operating members from transmitting to the casing. Furthermore, a hermetical chamber is defined around percussion hammers housed in the percussion tool. This hermetical chamber is filled with oil, thereby suppressing or absorbing hammer noises with the cooperative effect of the resilient member and the oil. However, this noise reduction mechanism is not effective for preventing the opponent member from generating noises, since the axial component of a percussion force transmitted from the hammer to the anvil is directly transmitted to the opponent member, without being effectively reduced or eliminated. The Unexamined Japanese Patent Application No. SHO 55-44136/1980 discloses an arrangement for providing a spiral spring connecting an output shaft of the percussion tool and a tip tool, for absorbing vibration occurring in an axial direction. However, this arrangement is disadvantageous in that the peak or maximum value of the fastening torque is lowered, resulting in remarkable deterioration of performance. Furthermore, the Unexamined Japanese Utility Model Application No. SHO 48-80199/1973 discloses an idea of interposing an elastic member between a spindle and an anvil. This is, however, not effective to prevent the axial force of the anvil from being directly transmitted to the opponent member; therefore, it is not possible to prevent the opponent member from causing noises in response to the percussion operation.

SUMMARY OF THE INVENTION

Accordingly, in view of an above-described problem encountered in the prior art, a principal object of the present invention is to provide a percussion hammer tool capable of reducing noises in operations, for example in a screw fastening work, by reducing an axial component of the percussion force acting on an opponent member, as well as effectively transmitting an angular component of the percussion force to a fastening member such as a screw.

In order to accomplish this and other related objects, an aspect of the present invention provides a percussion hammer tool comprising: a spindle rotating about an axis thereof, driven by a drive means; a percussion operating mechanism, slidably coupled with the spindle, for generating a percussion force to rotate and hit an anvil; the anvil being divided into an engaging portion engageable with the percussion operating mechanism and a tip tool holding portion for holding a tip tool, the engaging portion and the tip tool holding portion being locked with each other; a torque transmitting mechanism making the engaging portion and the tip tool holding portion displaceable with each other telescopically in an axial direction of the anvil; and a cushion member provided in a clearance space between the engaging portion and the tip tool holding portion, thereby transmitting an angular component of the percussion force while absorbing an axial component of the percussion force.

With this arrangement, it becomes possible to reduce the axial component of the percussion force acting on the opponent member, thus greatly suppressing the noises generated from the opponent member in operations, without deteriorating the efficiency of transmitting the angular component of the percussion force to the fastening member such as a screw.

It is preferable in the above percussion hammer tool that an additional cushion member is interposed between the spindle and the anvil.

Furthermore, it is preferable that the torque transmitting mechanism is constituted by a protrusion and a recess mating with the protrusion, which are formed on the engaging portion and the tip tool holding portion, respectively. For example, the protrusion is formed on the engaging portion so as to extend in the axial direction toward the tip tool holding portion, and the recess is formed on the confronting surface of the tip tool holding portion. The protrusion may be a square pole engageable with the recess being a square hole mating with this square hole. Moreover, the protrusion may be a spline having a gear-like cross section engageable with the recess formed into a gear-like hole mating with this spline. Furthermore, the protrusion may be a circular pole having flat surfaces extending along the axis thereof, each flat surface being cut along a chord of a cross section of the circular pole.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
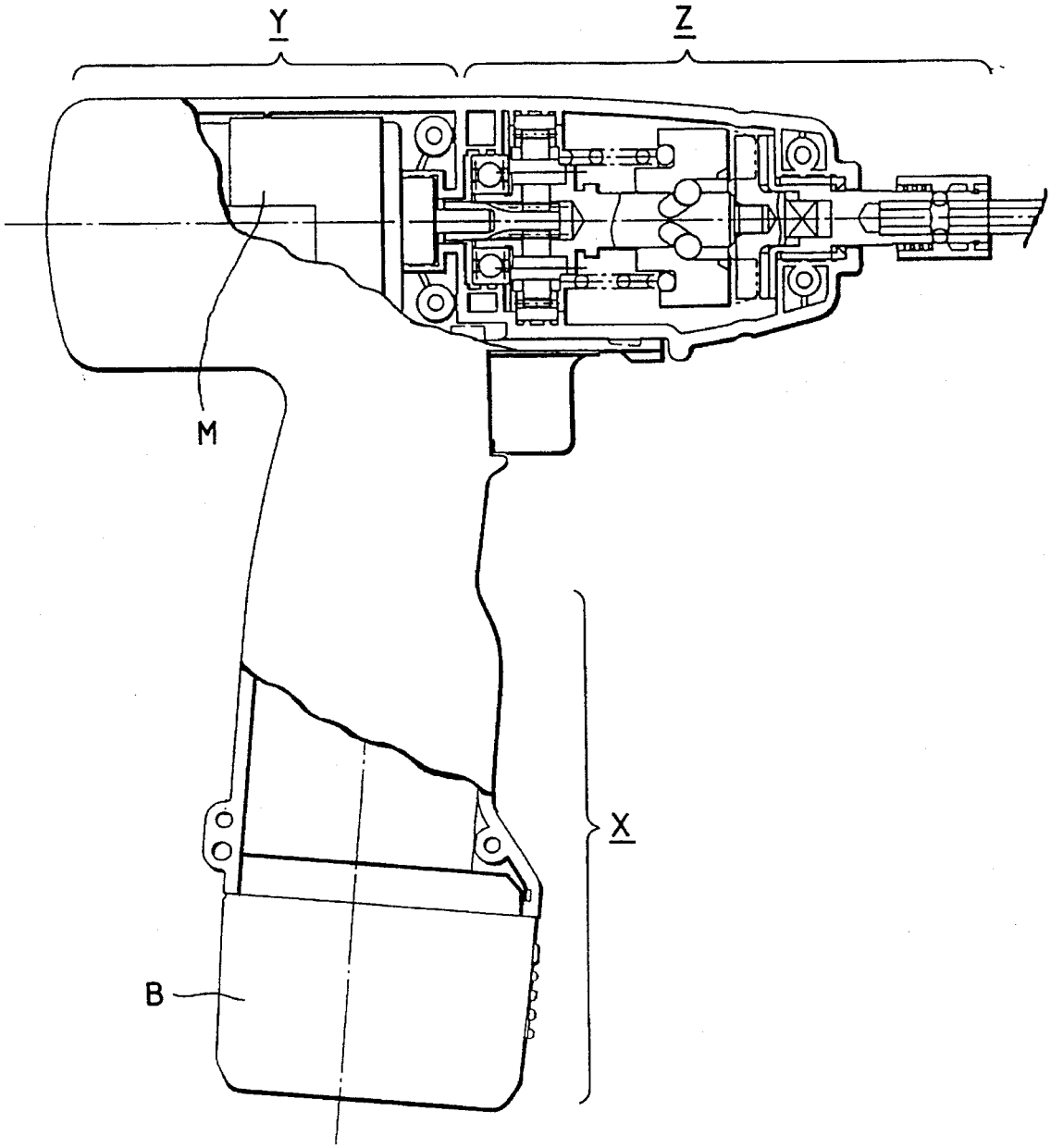
FIG. 1 is a partially sectional side view of a percussion hammer tool in accordance with a first embodiment of the present invention.

Preferred embodiments of the percussion hammer in accordance with the present invention will be explained in greater detail hereinafter, with reference to the accompanying drawings wherein the same reference numerals are applied to like parts.

FIG. 1 is a partially sectional side view of a percussion hammer tool in accordance with a first embodiment of the present invention. The percussion hammer tool consists of a grip section X including a battery B, a drive section Y including a motor M, and a percussion operating section Z.

Figure 2:
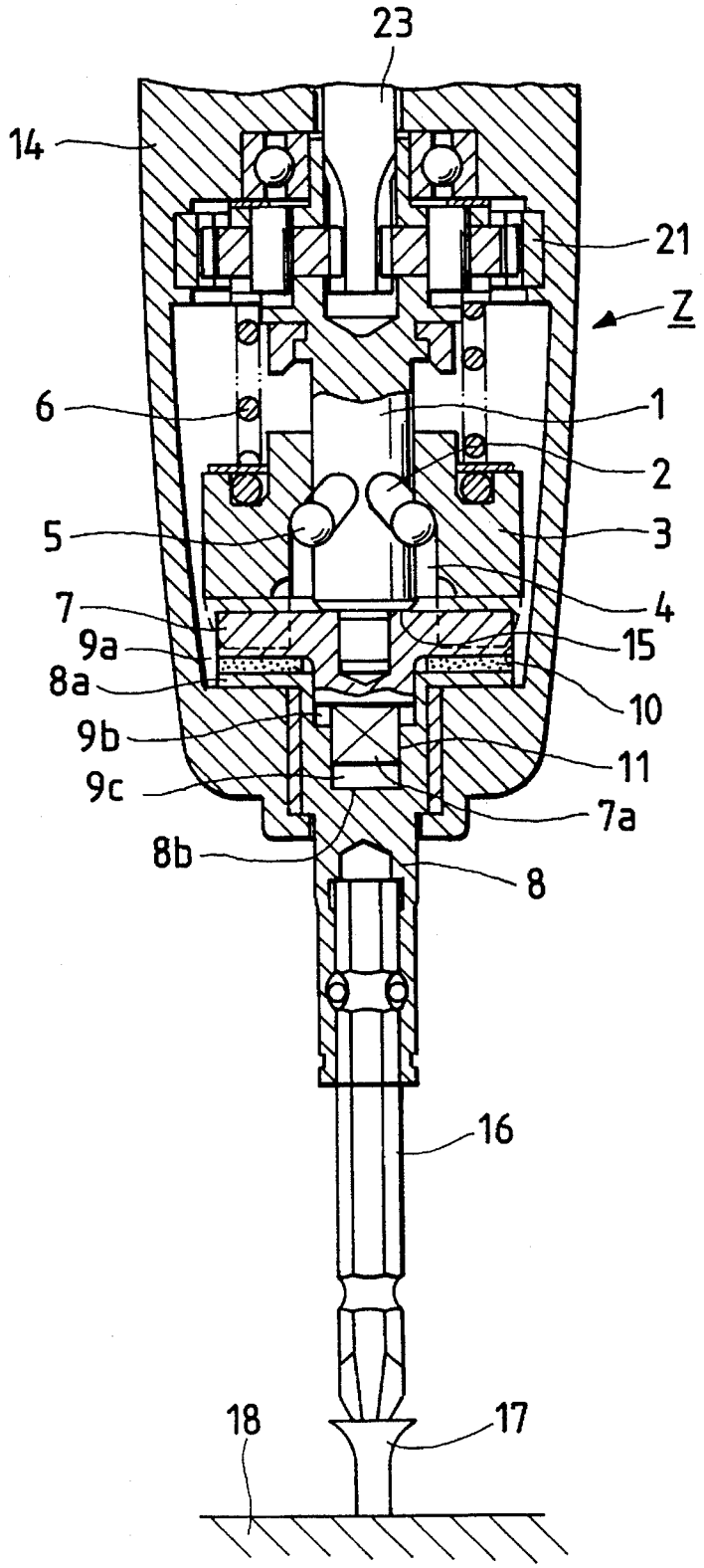
FIG. 2 is a vertical cross-sectional view showing details of the percussion hammer tool of the first embodiment.
Figure 3:
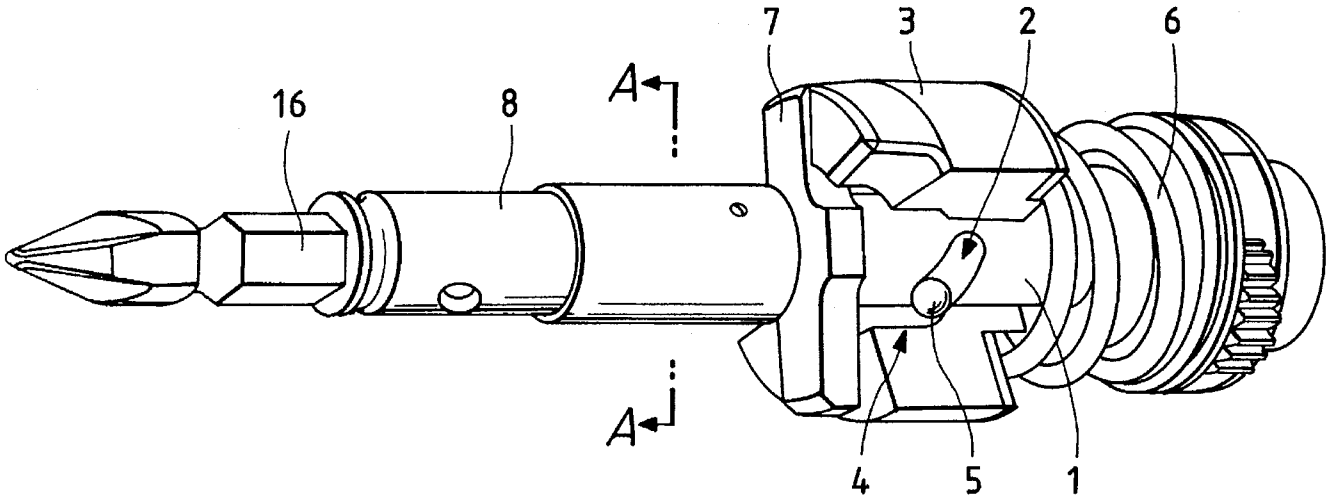
FIG. 3 is a perspective view showing a percussion operating section of the percussion hammer tool of the first embodiment.

FIG. 2 discloses details of the percussion operating section Z. FIG. 3 is a perspective view showing the percussion operating section Z. The percussion operating section Z comprises a spindle 1 extending in an axial direction. A base end of the spindle 1 is connected through a speed reduction device 21 to an output shaft 23 of the motor M. Thus, the spindle 1 causes rotation about an axis thereof, when the motor M is actuated. The other end of the spindle 1 is inserted into a cylindrical hammer 3. The cylindrical hammer 3 is coaxial and coupled with the spindle 1. A spindle cam 2, shaped into a groove oblique with respect to the axis of the spindle 1, is formed on an outer surface of the spindle 1. Meanwhile, a hammer cam 4, shaped into a recess, is formed on an inside surface of the hammer 3. A steel ball 5, interposed between the spindle 1 and the hammer 3, engages with both the spindle cam 2 and the hammer cam 4. With this engaging mechanism, the hammer 3 advances forward or retracts backward with respect to the spindle 1 in the axial direction. A spring 6 is disposed behind the hammer 3 to generate a force pushing the hammer 3 in the axial direction toward an anvil. The anvil is provided adjacent to and in front of the spindle 1 on an extension line of the axis of the spindle 1. The anvil is basically divided into two parts, one being engaging flange portion (i.e. engaging flanges) 7 serving as an engaging portion engageable with the hammer 3 and the other being a cylindrical shaft portion 8 serving as a tip tool holding portion holding a tip tool on the distal end thereof. The engaging flanges 7 are locked with the cylindrical shaft portion 8. The engaging flanges 7 oppositely extend in a radial direction from the base (rear) end of the anvil. Each engaging flange 7 of the anvil is engageable with one of the bifurcated front ends of the hammer 3. The cylindrical shaft portion 8 has a front end for fixedly holding a tip tool 16, such as a screwdriver.

There are provided clearances 9*a*, 9*b* and 9*c* between the engaging flange portion 7 and the cylindrical shaft portion 8 in the axial direction of the spindle 1, so as to telescopically displace the engaging flange portion 7 with respect to the cylindrical shaft portion 8 in the axial direction of the spindle. 1. A cushion member 10, such as an elastic member, is provided in the clearance space 9*a*. More specifically, the cylindrical shaft portion 8 has a base end flange 8*a* normal to the axis thereof as shown in FIG. 2, although the base end flange 8*a* is not shown in FIG. 3 for simplification. This base end flange 8*a* faces the engaging flanges 7, 7 with the clearance 9*a*. The cushion member 10 is interposed between the engaging flanges 7, 7 and the base end flange 8*a*. A protrusion 7*a* is formed at the center of the engaging flange portion 7, so as to extend in the axial direction toward the cylindrical shaft portion 8. A recess 8*b*, formed on the base (rear) side of the cylindrical shaft portion 8, mates with the protrusion 7*a*. The protrusion 7*a* and the recess 8*b*, paired with each other in the above-described manner, cooperatively constitute a torque transmitting mechanism 11.

Figure 6:
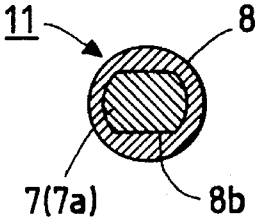
FIG. 6 is a view showing still another example of the torque transmitting mechanism.
Figure 5:
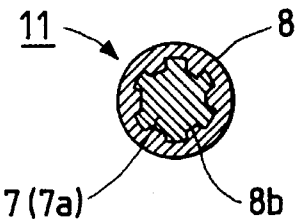
FIG. 5 is a view showing another example of the torque transmitting mechanism.
Figure 4:
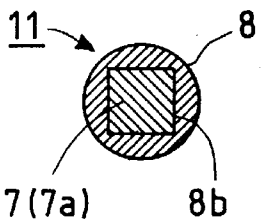
FIG. 4 is a cross-sectional view taken along a line A—A of FIG. 3, showing a torque transmitting mechanism.

FIG. 4 is a cross-sectional view taken along a line A—A of FIG. 3, showing an example of the torque transmitting mechanism 11. The torque transmitting mechanism 11 disclosed in FIG. 4 comprises the protrusion 7*a* of square pole fitted to the recess 8*b* having a corresponding square hole. Thus, the torque transmitting mechanism 11 transmits an angular component of percussion force from the engaging flange portion 7 to the cylindrical shaft portion 8 but absorbs an axial component of percussion force because of the engaging mechanism allowing the protrusion 7*a* to displace in the axial direction with respect to the cylindrical shaft portion 8 and existence of the cushion member (such as an elastic member) 10. FIG. 5 is another example of the torque transmitting mechanism 11 wherein a protrusion 7*a* is a spline having a gear-like cross section fitted to a recess 8*b* having a corresponding gear-like hole. Furthermore, FIG. 6 is still another example of the torque transmitting mechanism 11 wherein a protrusion 7*a* is a circular pole having flat surfaces extending along the axis thereof (i.e. along the cylindrical shaft portion 8), each flat surface being cut along a chord of a cross section of the circular pole, and the protrusion 7*a* is fitted to a recess 8*b* having a corresponding hole. A casing 14 houses above-described components.

Figure 7:
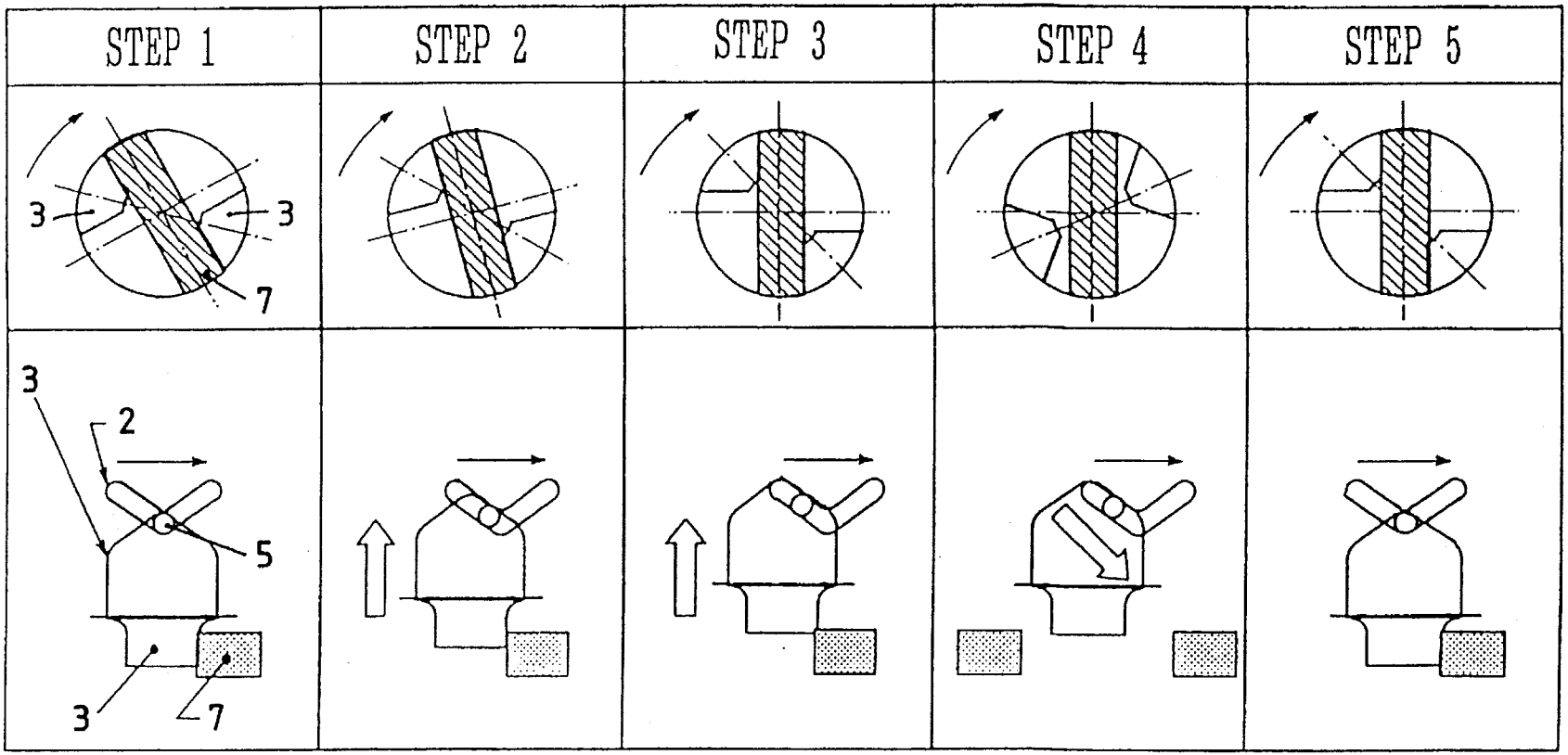
FIG. 7 is illustrations showing the percussion operation.

Operation of the percussion hammer tool will be explained below, with reference to FIG. 7. As long as a load is smaller than a predetermined value, the engaging flanges 7, 7 rotate in synchronism with the hammer 3 backed up by the resilient pushing force of the spring 6 (Step 1). When the load exceeds the predetermined value, rotational difference is caused between the spindle 1 and the hammer 3. Thus, the hammer 3 begins retracting rearward against the pushing force of the spring 6, being guided by the lead of the steel ball 5 (Step 2). The hammer 3 continues to retract rearward until the hammer 3 is disengaged from the engaging flange 7 (Step 3). As soon as the engagement is released between the engaging flange 7 and the hammer 3, the hammer 3 causes a free (no-load) angular displacement with respect to the engaging flange 7 accelerating its angular speed, advancing forward guided by the lead of the steel ball 5 (Step 4). Then, the hammer 3 hits the engaging flange 7 with a significant percussion force stored during the accelerated rotation (Step 5). Thus, one complete percussion operation is accomplished.

Figure 10:
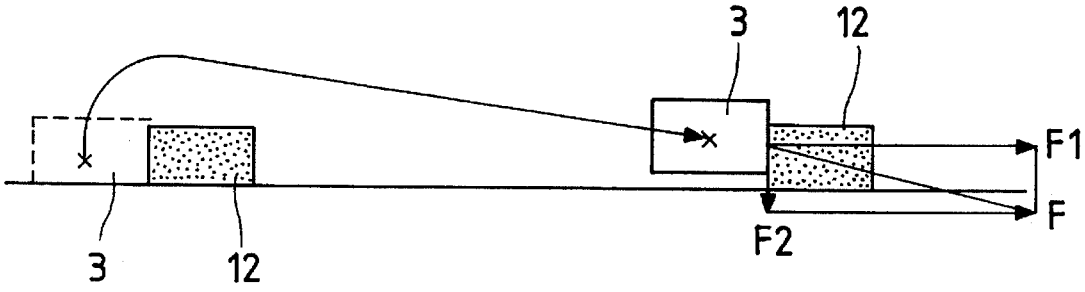
FIG. 10 PRIOR ART
FIG. 10 is a view illustrating angular and axial components of a percussion force generated in the percussion operation.
Figure 11:
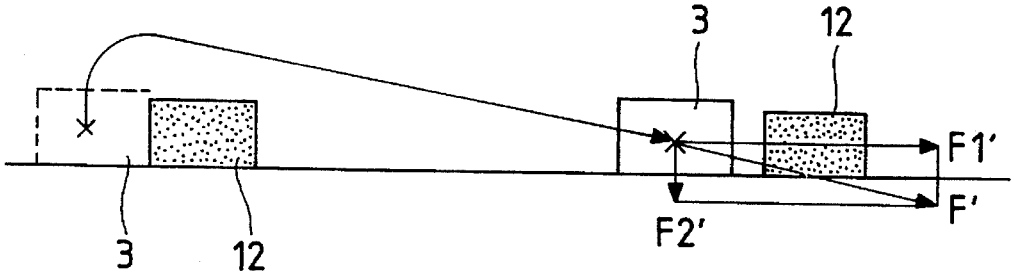
FIG. 11 PRIOR ART
FIG. 11 is a view illustrating angular and axial components of a percussion force generated in the percussion operation.

As explained with reference to FIGS. 10 and 11, the percussion force F transmitted from the hammer 3 to the engaging flange 7 of the anvil is divided into the angular component F1 and the axial component F2. This axial component F2 is transmitted from the anvil (i.e. the engaging flange portion 7 and the cylindrical shaft portion 8) to the opponent member 18 via the tip tool 16 and the screw 17, causing vibration of the opponent member 18 accompanying large noises.

However, the anvil of the present invention is divided into two parts (i.e. the engaging flange portion 7 and the cylindrical shaft portion 8) telescopically displaceable with each other in the axial direction. Namely, the clearances 9*a*, 9*b* and 9*c* are provided between the engaging flange portion 7 and the cylindrical shaft portion 8 in the axial direction of the spindle 1, so as to make the engaging flange portion 7 telescopically displaceable with respect to the cylindrical shaft portion 8 in the axial direction of the spindle 1. And, the cushion member 10 is provided in one of a plurality of clearances (i.e. the clearance 9*a*). Thus, the axial component F2 of the percussion force is effectively absorbed so as not to be directly transmitted to the opponent member 18, thereby greatly suppressing the noises so as not to be generated from the opponent member 18.

Figure 8:
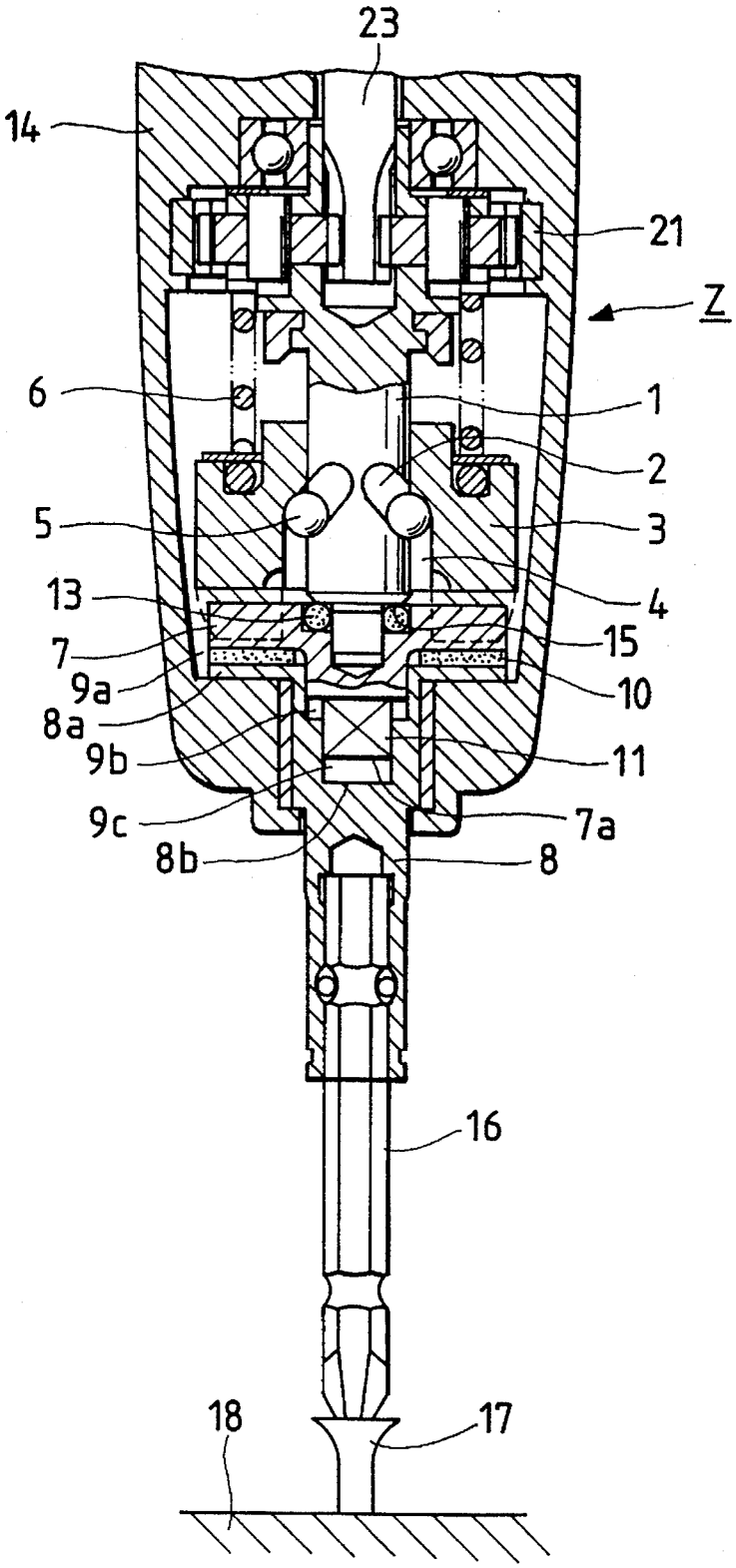
FIG. 8 is a vertical cross—sectional view showing details of a percussion hammer tool in accordance with a second embodiment of the present invention.
Figure 9:
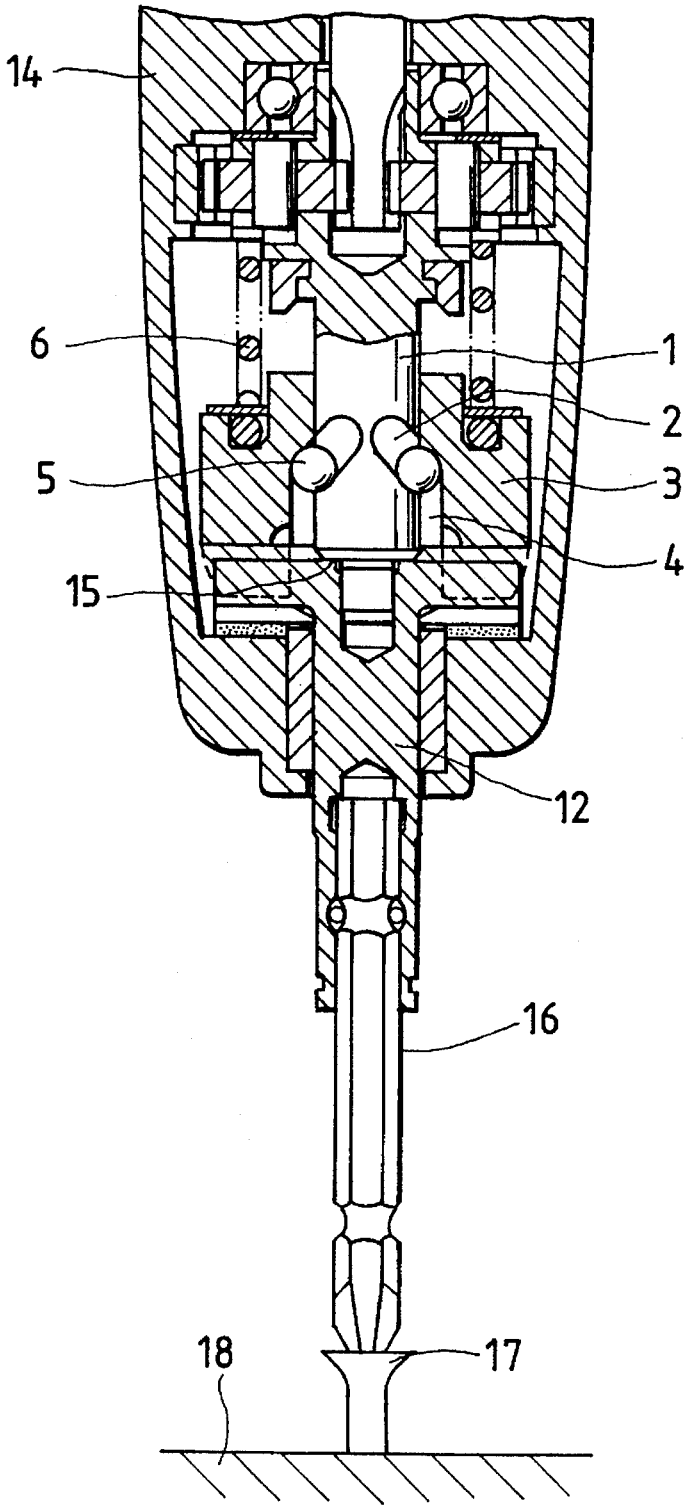
FIG. 9 PRIOR ART
FIG. 9 is a vertical cross—sectional view showing a conventional percussion hammer.

FIG. 8 is a vertical cross-sectional view showing details of a percussion hammer tool in accordance with a second embodiment of the present invention. The second embodiment is substantially the same as the first embodiment except that an additional cushion member (such as an elastic member) 13 is interposed between the spindle 1 and the anvil (i.e. the engaging flange portion 7) at the abutting portion 15.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A percussion hammer tool comprising:

a spindle driven by a drive means about an axis;

a percussion operating mechanism, slidably coupled with said spindle, for generating a percussion force to rotate and hit an anvil;

said anvil being divided into an engaging portion engageable with said percussion operating mechanism and a tip tool holding portion for holding a tip tool, said engaging portion and said tip tool holding portion being angularly locked with each other having confronting faces separated from each other with a clearance space, said confronting faces being normal to an axis of said anvil;

a torque transmitting mechanism transmitting an angular component of said percussion force from said engaging portion to said tip tool holding portion, while making said engaging portion and said tip tool holding portion displaceable telescopically along an axis of said anvil; and a cushion member provided in said clearance space between said confronting surfaces of said engaging portion and said tip tool holding portion, so that said cushion member suppresses noise produced from an axial component of said percussion force transferred from said engaging portion to said tip tool holding portion;

wherein said confronting faces are normal to the axis of said anvil and are constituted by a flange provided at a base end of said tip tool holding portion, and by an engaging flange of said engaging portion engageable with said percussion operating mechanism.

2. The percussion hammer tool in accordance with claim 1 further comprises an additional cushion member interposed between said spindle and said anvil.

3. The percussion hammer tool in accordance with claim 1, wherein said torque transmitting mechanism is constituted by a protrusion and a mating recess.

4. The percussion hammer tool in accordance with claim 3, wherein said protrusion and said recess are formed on said engaging portion and said tip tool holding portion, respectively.

5. The percussion hammer tool in accordance with claim 3, wherein said protrusion is formed on said engaging portion so as to extend in the axial direction toward said tip tool holding portion, and said recess is formed on said tip tool holding portion.

6. The percussion hammer tool in accordance with claim 3, wherein said protrusion is a square pole and said recess is a square hole mating with said square pole.

7. The percussion hammer tool in accordance with claim 3, wherein said protrusion is a spline having a gear-like cross section and said recess is a gear-like hole mating with said spline.

8. The percussion hammer tool in accordance with claim 3, wherein said protrusion is a circular pole having flat surfaces extending along an axis thereof, each flat surface being cut along a chord of a cross section of said circular pole, and said recess has a hole mating with said circular pole.

9. The percussion hammer tool comprising:

a spindle being driven by a drive means to rotate about an axis thereof;

a percussion operating mechanism, slidably coupled with said spindle, for generating a percussion force to rotate and hit an anvil;

said anvil being divided into an engaging portion engageable with said percussion operating mechanism and a tip tool holding portion for holding a tip tool;

said engaging portion and said tip tool holding portion being arrayed sequentially with a clearance therebetween along an axis of said anvil, and angularly locked with each other;

a torque transmitting mechanism transmitting an angular component of said percussion from said engaging portion to said tip tool holding portion, while making said engaging portion and said tip tool holding portion displaceable telescopically in an axial direction of said anvil; and a cushion member provided in said clearance space between said engaging portion and said tip tool holding portion, so that said cushion member suppresses noise produced from an axial component of said percussion force transferring from said engaging portion to said tip tool holding portion, wherein each of said engaging portion and said tip tool holding portion has similar configuration with a rear end of each of said engaging portion and said tip tool holding portion formed into a flange normal to said anvil ax, and said tip tool holding portion has a recess at the rear end thereof which is engaged with a front end of said engaging portion.

10. The percussion hammer tool in accordance with claim 9, wherein said cushion member is interposed between said flanges of said engaging portion and said tip tool holding portion.

11. The percussion hammer tool in accordance with claim 9, wherein said torque transmitting mechanism is constituted by said recess of said tip tool holding portion and said front end of said engaging portion.

* * * * *